US006467770B1

(12) United States Patent
Matosevic

(10) Patent No.: US 6,467,770 B1
(45) Date of Patent: Oct. 22, 2002

(54) ROULETTE GAME

(76) Inventor: Anto Matosevic, Goldegggase 17/4, A-1040, Wien (AT)

( * ) Notice: Subject to any disclaimer, the term of this patent is extended or adjusted under 35 U.S.C. 154(b) by 0 days.

(21) Appl. No.: 09/515,568

(22) Filed: Feb. 29, 2000

(51) Int. Cl.[7] ..... A63F 3/08; A63F 1/18; A63F 1/00; A63B 71/00

(52) U.S. Cl. ..... 273/274; 273/142 R; 273/138.1

(58) Field of Search ..... 273/142 E, 142 F, 273/142 G, 142 R, 142 A, 142 B, 142 C, 142 D, 274, 280, 138.3, 269, 143 R, 143 A; D21/342, 369, 374, 375

(56) References Cited

U.S. PATENT DOCUMENTS

D106,967 S * 11/1937 Danon ..... D21/347
4,357,015 A 11/1982 Santora et al.
5,273,431 A 12/1993 Charouhas
5,540,442 A * 7/1996 Orselli et al. ..... 473/17
5,553,853 A 9/1996 Sackitey
5,690,337 A * 11/1997 Somma et al. ..... 273/309
5,746,432 A * 5/1998 Feola ..... 273/274
5,755,440 A 5/1998 Sher
5,857,909 A 1/1999 Rubin
5,934,999 A * 8/1999 Valdez ..... 463/17
6,164,647 A * 12/2000 Chee ..... 273/142 R
6,176,489 B1 * 1/2001 Astaneha ..... 273/274
6,209,869 B1 * 4/2001 Mathews ..... 273/138.1

* cited by examiner

*Primary Examiner*—Paul T. Sewell
*Assistant Examiner*—Alvin A Hunter
(74) *Attorney, Agent, or Firm*—Armstrong Teasdale LLP

(57) ABSTRACT

An improved Roulette game includes at least one "Dead Number" pocket on a Roulette wheel. When a Roulette ball comes to rest in a Dead Number pocket, a "Dead Number" is declared and all bets are collected except bets on specifically numbered pockets of the wheel, which are given a second chance in a new deal when the wheel is rotated again in the opposite direction to the previous spin. New bets may be placed for a period of time until "No more bets" is announced.

9 Claims, 6 Drawing Sheets

ROULETTE GAME

BACKGROUND OF THE INVENTION

This invention relates generally to games of chance and, more particularly, to an enhanced form of the table game known as Roulette.

Historically, the game of Roulette has succeeded in attracting the attention of casino gamblers worldwide, and includes a Roulette wheel having a plurality of numbered pockets (38 pockets in "American Roulette," 37 pockets in "European Roulette") around a periphery inside a bowl shaped housing. Each pocket is associated with a color as well, such as red or black in conventional Roulette, that creates a background for each number of the numbered pockets. The housing is adapted to spin or rotate about a vertical axis, and an operator, or croupier, introduces a ball into the spinning Roulette wheel housing tangentially to the periphery of the wheel and in a direction opposite to the rotation of the wheel. Typically, the ball travels around the periphery of the housing multiple times before falling toward the center of the wheel. Ultimately, the ball comes to rest in one of the pockets in the Roulette wheel. Typically, a number of obstacles on the outer periphery prevents a simple, harmonious fall of the ball and assures the character of Roulette as a game of chance.

Gamblers place bets on where the ball will ultimately come to rest for each round of the game by placing chips or markers on a bet layout on the surface of the Roulette table. The markers or chips are placed in a position corresponding to the wager made on the outcome of the round. For example, a player may bet on a single pocket number by placing a chip on the corresponding place on the layout. If the player wins the bet, he wins a payout depending on the odds of winning the bet, which is, for example, typically 35:1 for a "straight up" bet on a particular numbered pocket of the wheel. Other number combination bets that may be made include a "split" that the ball will fall into one of two numbered pockets with 17:1 odds, a "corner " bet that the ball will fall into one of four numbered pockets with 8:1 odds, a "street" bet that the ball will fall into one of three numbered pockets with 11:1 odds, and a "six line" bet that the ball will fall into one of six numbered pockets with 5:1 odds.

A variety of other bets with smaller payouts may be made as well, including whether the ball will land in a "odd" or "even" pocket, a "small" pocket (one of pockets 1–18), a "big" pocket (one of pockets 19–36), a black pocket or red pocket for which the payout is 1:1, and a "dozen" bet and a "column" bet for which the payout is 2:1. If the ball lands in the pocket numbered "0" (or "00" in American Roulette), in one version of the game the house wins every bet, i.e., every bet loses, except bets wagered on the "0" pocket (or "00" in American Roulette). In another version of the game popular in Europe, all bets except 1:1 payout bets and bets wagered on the "0" pocket (or "00" in American Roulette) lose, and 1:1 payout bets lose half of their value when the ball lands in the pocket numbered "0" (or "00" in American Roulette). While Roulette is an enjoyable game, the basic routine of the game has been unchanged for decades, and the popularity of Roulette is losing ground to newer, faster-paced games of chance with larger payouts.

Accordingly, it would be desirable to provide a fresh, more exciting game of Roulette to recapture the interest of gamblers.

BRIEF SUMMARY OF THE INVENTION

In an exemplary embodiment of the invention, a Roulette game includes a Roulette wheel adapted for rotation about a vertical axis and at least one bet layout. The Roulette wheel includes a plurality of numbered pockets indicated by a color and a number greater than zero on a periphery of the wheel, and at least one "Dead Number" pocket indicated by non-number indicia and a color other than the colors of the numbered pockets. The bet layout includes a plurality of regions on which to place a bet on the final position of the ball in the Roulette wheel for each round of play. Bets are placed by positioning a marker in a respective region on the bet layout.

In accordance with traditional Roulette, the Roulette wheel is rotated about the vertical axis after players have placed their bets. At least one ball is introduced tangentially to the periphery of the wheel and in a direction opposite the rotation of the wheel. Eventually, gravitational forces cause the ball to fall into a pocket on the wheel. Once the ball has come to a final position, bets are paid or collected in accordance with conventional Roulette.

However, if the ball falls into the Dead Number pocket, a "Dead Number" is declared and all bets are collected except bets on individually numbered pockets and all the other number combinations of the wheel. In other words, the bets on individually numbered pockets are unaffected, namely "straight up" bets, "split" bets, "corner" bets, "street" bets and "six line" bets, while all other bets lose, namely "dozen" bets, "column" bets, even bets, odd bets, red bets, black bets, "small" bets, and "big" bets. A new deal is declared after all bets have been collected except bets on individually numbered pockets of the wheel. In the new deal the Roulette wheel is rotated in the opposite direction as the preceding spin, and at least one ball is again introduced tangentially to the periphery of the wheel and in a direction opposite the rotation of the wheel for a new round of play. New bets may be placed until "No more bets" is announced.

Thus, the Dead Number provides a second chance for bets on individually numbered pockets, and the spinning of the wheel in the opposite direction after a Dead Number adds a new dynamic to the game. No region on the bet layout corresponds to the Dead Number pocket, so bets cannot be placed on the Dead Number. Instead, the higher payout bets are given another chance and the lower payout bets are collected when the ball falls into a Dead Number pocket. Thus, a simple but interesting sequence of events is added to the game that makes the game more enjoyable and exciting.

DETAILED DESCRIPTION OF THE INVENTION

Figure 1:
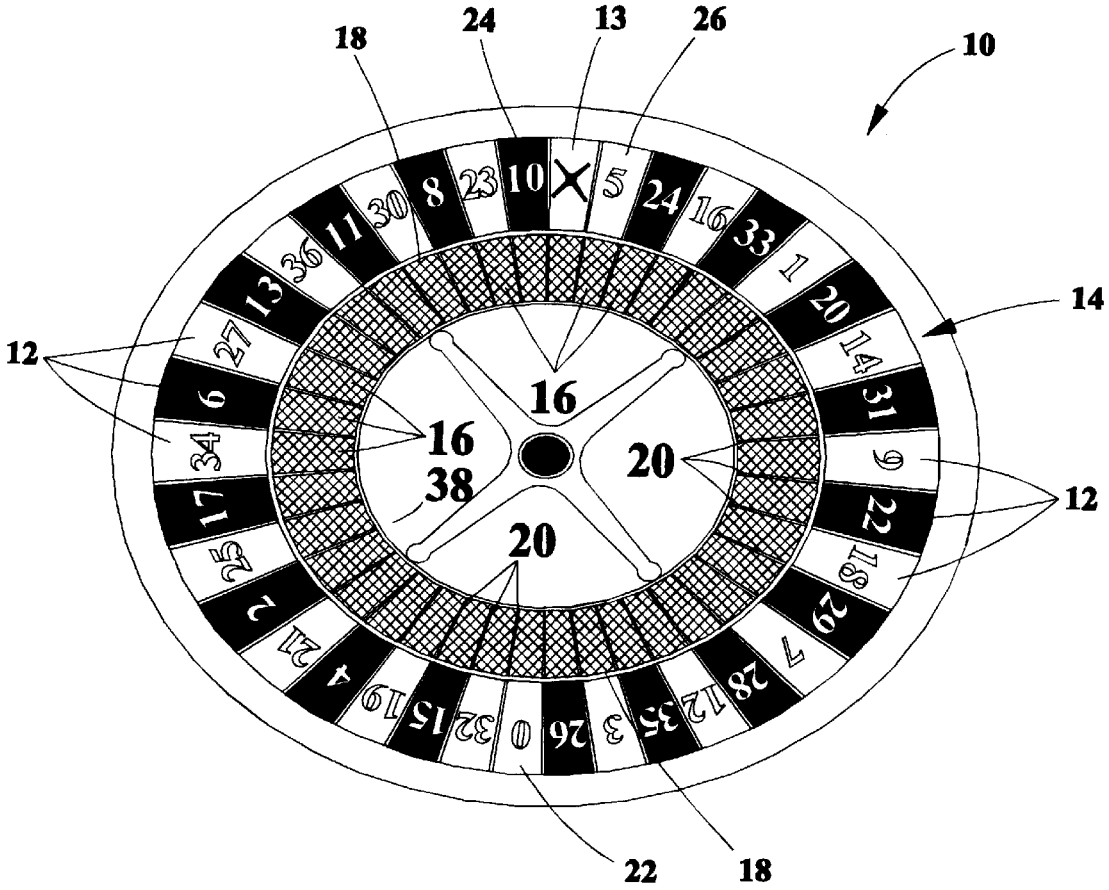
FIG. 1 is a top plan view of a Roulette wheel including a "Dead Number" pocket in accordance with a first embodiment of the invention.

FIG. 1 is a top plan view of a Roulette wheel 10 in accordance with the present invention. Roulette wheel 10 includes a plurality of fields 12 around an outer periphery 14 of wheel. Fields 12 include an indicia, such as an arabic number 0–36, or a symbol, such as "Dead Number" field 13, corresponding to a plurality of pockets 16 located around an inner periphery 18 of wheel 10. Each pocket 16 is formed by dividers 20 below each field 12, and each pocket 16 is generally referred to by the corresponding field 12. For example, the "0" pocket is the pocket aligned with the "0" field.

Each field 12 numbered 1–36 is associated with a color, which is red or black by convention, that forms a background for each number. A "0" field 22 is conventionally associated with the color green. The arrangement of fields 12 numbered 0–36 around outer periphery 14 of wheel is also conventional. It is recognized, however that greater or fewer numbers of fields 12 and pockets 16 could be used, and that non-conventional distribution of fields 12 around wheel outer periphery 14 and non-conventional background colors for fields 12 could be used in the game of the present invention.

Wheel 10 is similar to a "European" or "Single Zero" wheel. However, unlike conventional European Roulette wheels, wheel 10 includes "Dead Number" field 13 that is the same size as fields 12. Thus, instead of the conventional thirty-seven fields numbered zero through thirty-six, wheel 10 includes an additional Dead Number field 13, or a total number of thirty-eight fields and pockets 16. As shown, Dead Number field 13 is positioned substantially opposite "0" field 22 on wheel outer periphery 14 and located between a "10" field 24 and a "5" field 26. Of course, Dead Number field 13 could be positioned anywhere on wheel outer periphery 14 without affecting the play of the game as described below.

Figure 2:
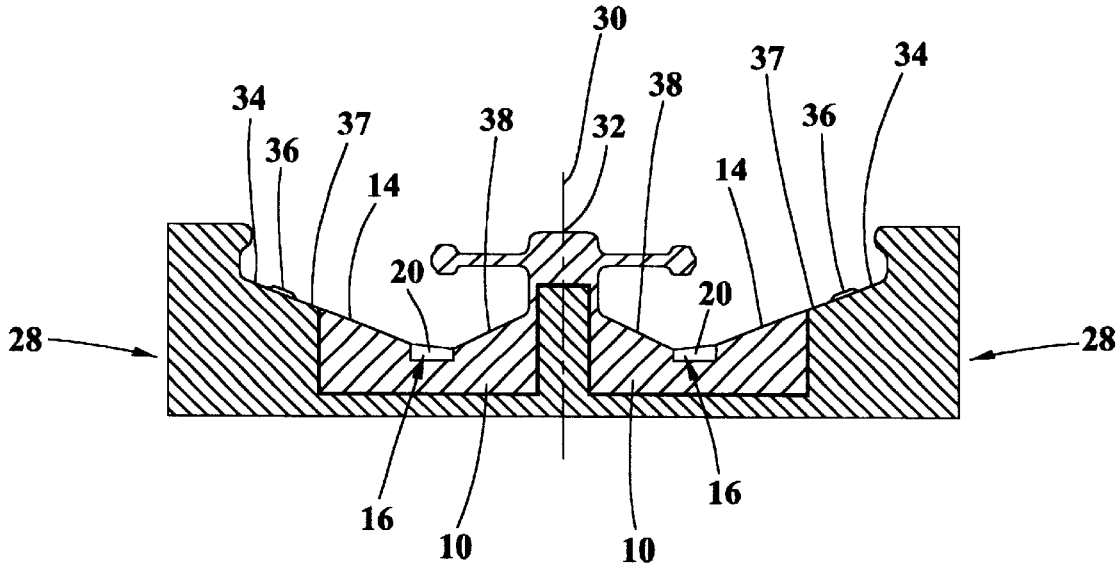
FIG. 2 is a cross sectional view of the Roulette wheel shown in FIG. 1 installed in a Roulette table.

FIG. 2 is a cross sectional view of Roulette wheel 10 installed in a Roulette table 28 for rotational movement about a rotational axis 30 through a center 32 of wheel 10. Table 28 includes an outer periphery 34 including a plurality of obstacles 36 to prevent a simple and harmonious fall of a Roulette ball and to randomly direct a Roulette ball about Roulette wheel 10. Table outer periphery 34 is inwardly inclined, i.e. sloped downward toward wheel rotational axis 30. Wheel outer periphery 14 is adjacent an inner edge 37 of table outer periphery 34 and also inwardly inclined toward wheel rotational axis 30. Pockets 16 formed by dividers 20 are positioned adjacent wheel outer periphery 14, and a center portion 38 of wheel 10 is outwardly inclined, i.e., sloped upward toward wheel rotational axis 30. Thus, table outer periphery 34, wheel outer periphery 14, and wheel center portion 38 are arranged to direct a Roulette ball toward pockets 16 once a Roulette ball is launched onto table outer periphery 34.

Figure 3:
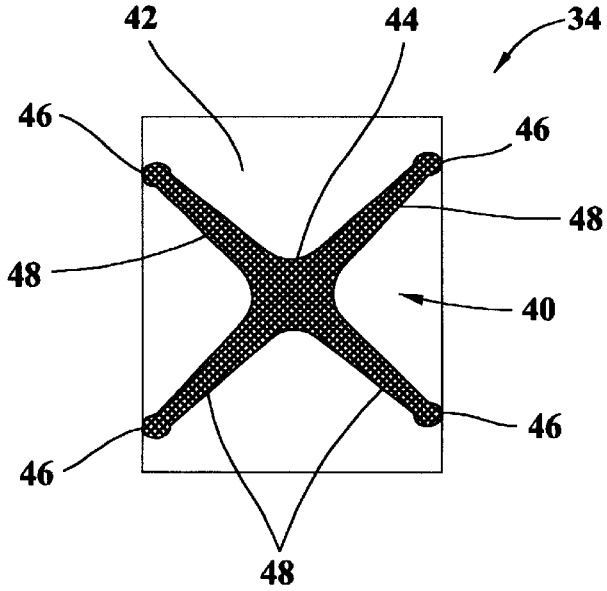
FIG. 3 is a top plan view of the "Dead Number" shown in FIG. 1.

FIG. 3 is a top plan view of "Dead Number" field 13 indicia which, in a particular embodiment is a black star 40 against a white background 42. Star 40 is formed of an X-shaped inner member 44 with a substantially circular cap 46 on each of four legs 48. In alternative embodiments, other non-numbered indicia and other indicia colors and background colors could be used to indicate Dead Number field 13.

Figure 4:
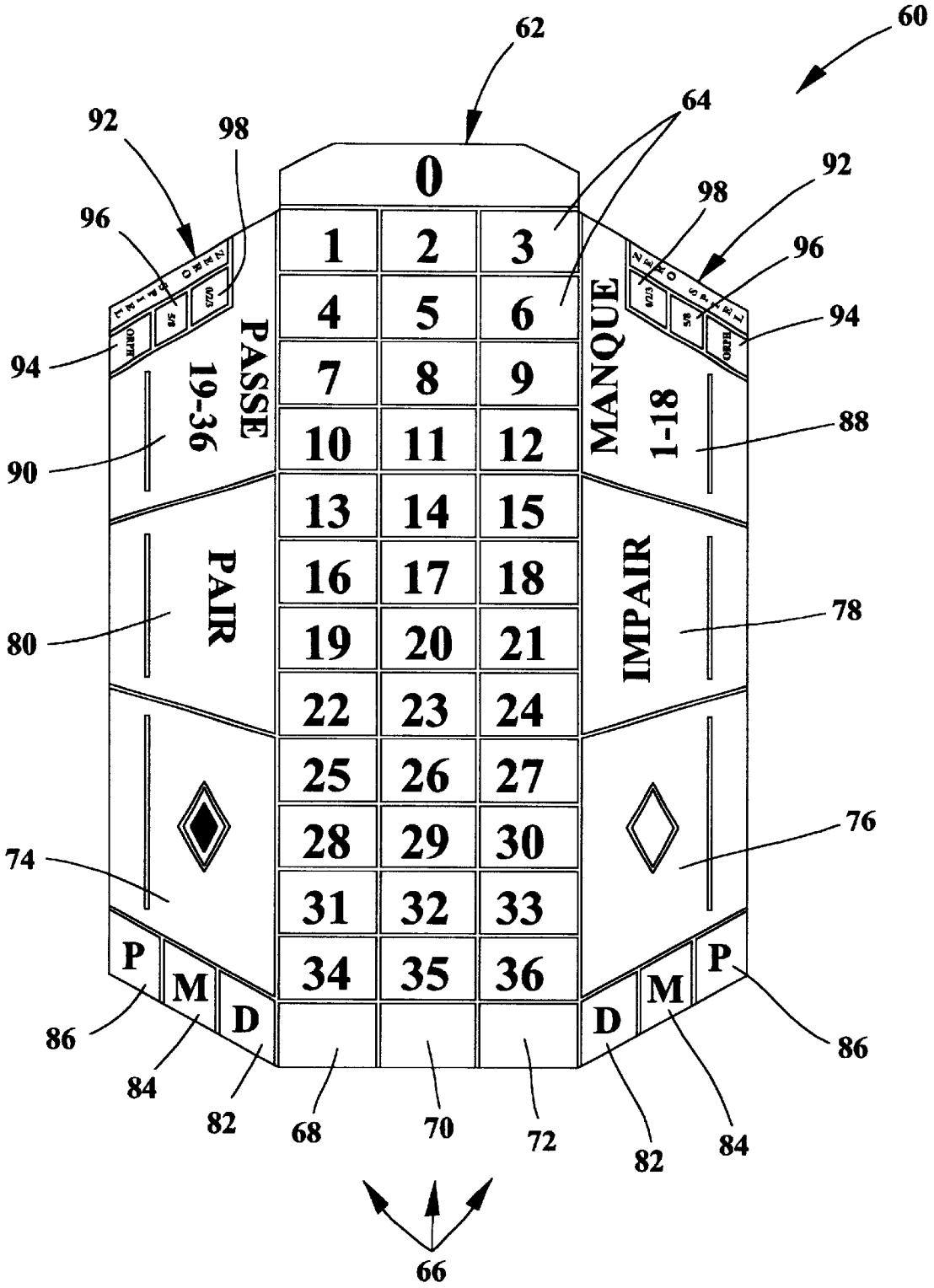
FIG. 4 is a top plan view of a first embodiment of a bet layout for use with the wheel shown in FIG. 1.

FIG. 4 is a top plan view of a first embodiment of a bet layout 60 for use with Roulette wheel 10 (shown in FIG. 1) that will be recognized by those of skill in the art as "French" layout upon which a combination of bets may be made with varying payouts for wagering on the ultimate position of a Roulette ball (not shown) in wheel 10 at the conclusion of each round of play. More specifically, a center portion 62 of layout 60 includes regions 64 numbered 0–36 and corresponding to a respective pocket on wheel 10 (shown in FIG. 1). The payout for bets placed in center portion 62 is typically in accordance with the odds of winning the bet: 35:1 for a "straight up" bet, 17:1 for a "split" bet, 8:1 for a "corner" bet, 11:1 for a "street" bet, and 5:1 for a "six line" bet. Three column bets 66 are positioned below center portion and pay 2 to 1 if the Roulette balls lands in any of the pockets in wheel 10 corresponding to the indicated pockets in a left column 68 containing the number "34", a center column 70 containing the number "35" and a right column 72 containing the number "36."

On either side of center portion 62 are even money bets, including a "black" region 74, a "red" region 76, an "odd" region 78, an "even" region 80, a "small" region 88 corresponding to pockets numbered 1–18, and a "big" region 90 corresponding to numbered pockets 19–36 that each returns a dollar for every dollar bet in the region when the Roulette ball lands in a corresponding pocket of wheel 10 (shown in FIG. 1). Thus "black" region 74 returns a dollar for every dollar bet if the Roulette ball lands in a black pocket, "red" region 76 returns a dollar for every dollar bet if the Roulette ball lands in a red pocket, "odd" region 78 returns a dollar for every dollar bet if the Roulette ball lands in an odd-numbered pocket, "even" region 80 returns a dollar for every dollar bet if the Roulette ball lands in an even-numbered pocket, "small" region 88 returns a dollar for every dollar bet if the Roulette ball lands in a pocket numbered 1–18, and "big" region 90 returns a dollar for every dollar bet if the Roulette ball lands in a pocket numbered 19–36.

Below even bet regions 74, 76, 78, 80, 88 and 90 are 2 to 1 payout bet regions including a "first dozen" region 86 corresponding to numbered pockets 1–12, a "second dozen" region 84 corresponding to numbered pockets 13–24, and a "third dozen" region 82 corresponding to numbered pockets 25–36.

Regions 92, 94, 96, and 98 are located adjacent "small" region 88 and "big" region 90 on either side of center portion 62 to facilitate play of the game. Each region represents a section of Roulette wheel 10 and is played with a prescribed number of chips. In accordance with traditional Roulette, a "split" bet is a bet made on a selected region wherein a chip is placed on a dividing line, i.e., the split, between two numbers. For example, a "0" and "3" split bet is made by placing a chip on the split between "0" and "3" on bet region 62, thereby betting that the ball will land in one of pockets "0" and "3." Also, a "straight up" bet is a single bet on a designated pocket made by placing a chip over the designated number in a bet region, but not on a split. Where appropriate, split bets and straight up bets are designated in parentheses in the following description.

Region 92, sometimes referred to as "zero spiel" represents seven pockets on Roulette wheel 10, namely the seven pockets spanning between and including pockets numbered "12" and "15" and is played with four chips corresponding to pockets "0" and "3" (split), pockets "12" and "15" (split) pocket "26" (straight up) and pockets "32" and "35" (split).

Region 94, sometimes known as "orphans," represents eight pockets on Roulette wheel 10, namely three pockets spanning between and including pockets numbered "17" and "6" and five pockets spanning between and including pockets numbered "1" and "9." Region 94 is played with five chips corresponding to pocket "1" (straight up), pockets "6" and "9" (split), pockets "14", "17", and "20"—pockets "14" and "17" (split), and pockets "17" and "20" (split)—and pockets "31" and "34" (split).

Region 96, sometimes known as "set 5/8" or "small series" represents twelve pockets spanning between and including pockets numbered "27" and "33" on Roulette wheel 10 and is played with six chips corresponding to pockets "5" and "8" (split), pockets "10" and "11" (split), pockets "13" and "16" (split), pockets "23" and "24" (split), pockets "27" and "30" (split) and pockets "33" and "36" (split).

Region 98, sometimes known as "0/2/3" or "large series" represents seventeen pockets spanning between and including pockets numbered "22" and "25" on Roulette wheel 10 and is played with nine chips corresponding to pockets "0, "2" and "3 (street, marked with two chips), pockets "4" and "7" (split), pockets "12" and "15" (split), pockets "18" and "21" (split), pockets "19" and "22" (split), pockets "25," "26," "28" and "29" (corner, marked with two chips), and pockets "32" and "35" (split).

Bets are made by placing the prescribed number of chips into a selected region 92, 94, 96, 98. When the Roulette ball lands in a pocket 16 (shown in FIG. 1) of a marked region 92, 94, 96, 98, a dealer replaces the chips from the region to the winning number in center portion 62 and the bet is to be paid.

It is therefore evident that a complicated combination of bets may be concurrently made on layout 60, and when multiple Roulette balls are used, some skill is required to track the progress of the game. Bets are made by placing one or more markers or chips (not shown) on a selected region of layout 60, and bets are either awarded to layout 60 or collected from layout 60 by house staff between rounds of play. Typically, a plurality of layouts 60 are positioned on a Roulette table (not shown) so that multiple players can play simultaneously.

In one form, traditional Roulette is played as follows. Players place their bets on layout 60 and Roulette wheel 10 is rotated about rotational axis 30 (shown in FIG. 1 and 2). At least one ball is introduced tangentially to the outer periphery 14 of wheel 10 and in a direction opposite the rotation of wheel 10 according to known methods in the art. After multiple revolutions around wheel 10, the Roulette ball is pulled downward into one of wheel pockets 16 by gravitational forces. Once the ball has come to a final position in a particular pocket 16, bets are paid or collected in accordance with bets placed on layout 60.

However, if the ball falls into the Dead Number pocket, i.e, the pocket corresponding to Dead Number Field 13 (shown in FIGS. 1 and 3), a "Dead Number" is declared and all bets are collected except bets on individually numbered pockets of wheel 10. In other words, the bets on individually numbered pockets 16, i.e., the bets placed in center portion 62 of layout 60 and the corresponding bets in regions 92, 94, 96, and 98, are unaffected, while bets in all remaining regions 66–90 lose and are collected by the house. A new deal is declared after all bets have been collected except bets on center portion 62 for individually numbered pockets 16 of wheel 10. In the new deal, Roulette wheel 10 is again rotated in the opposite direction to the preceding spin, and the Roulette ball is again introduced tangentially to outer periphery 14 of wheel 10 and in a direction opposite the rotation of wheel 10 for a new round of play. New bets may be placed until "No more bets" is announced.

No region on bet layout 60 corresponds to the Dead Number pocket, so bets cannot be placed on the Dead Number pocket. Thus, instead of creating another betting opportunity on layout, the Dead Number pocket gives previously chosen, high payout bets another, or second, chance while forfeiting lower bets when the ball falls into the Dead Number pocket. Thus, a simple but interesting sequence of events is added to the game that makes the game more enjoyable and exciting.

Figure 5:
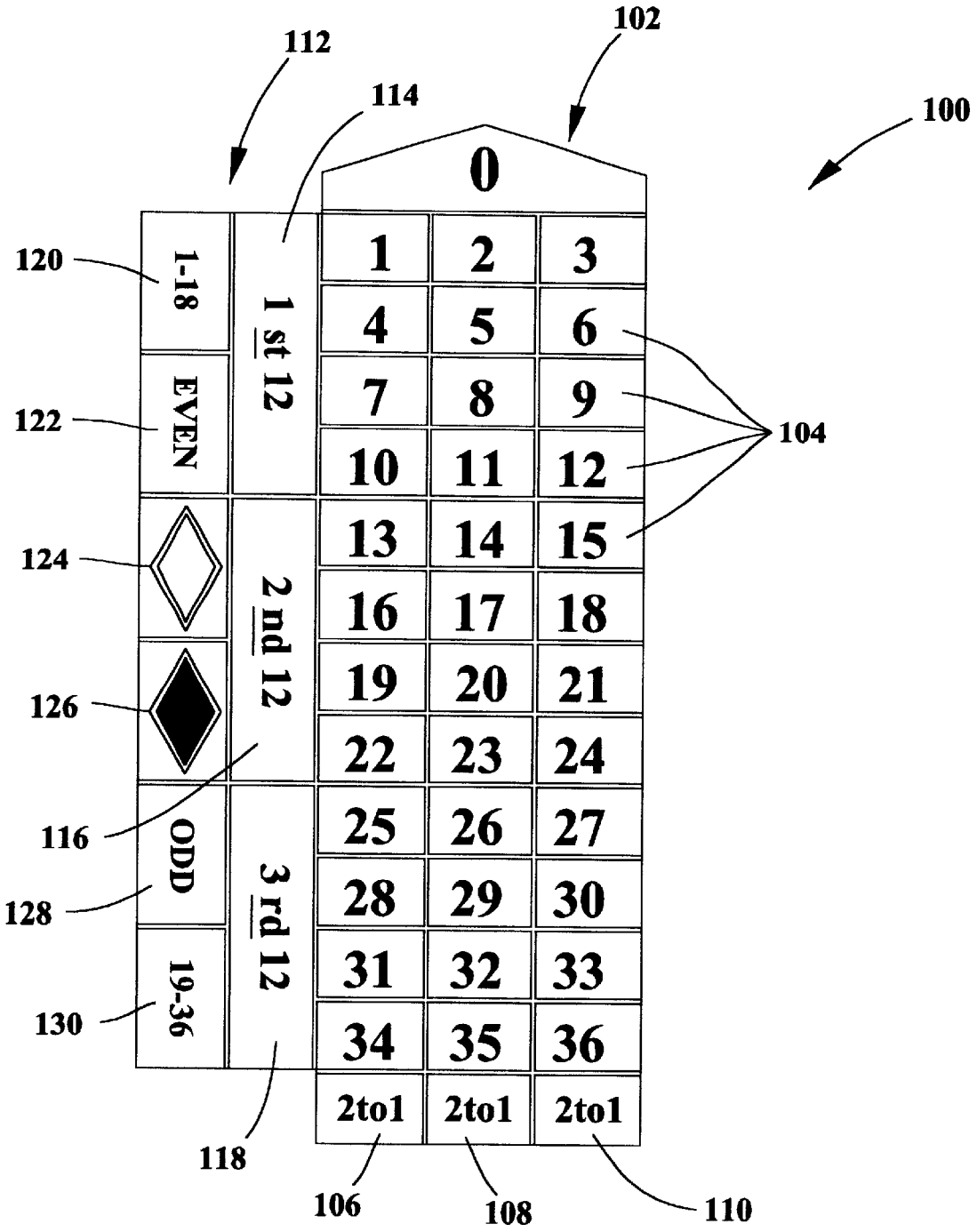
FIG. 5 is a top plan view of a second embodiment of a bet layout for use with the wheel shown in FIG. 1.

FIG. 5 illustrates a second embodiment of a layout 100 for use with wheel 10 (shown in FIG. 1) that the gaming enthusiast will recognize as an "American" layout. A center portion 102 includes a plurality of regions 104 corresponding to numbered pockets 16 of wheel 10. Three column bet regions 106, 108, 110 are located adjacent and underneath center portion 102. A left portion 112 includes a "first dozen" region 114, a "second dozen" region 116, a "third dozen" region 118, a "1–18" region 120, an even region 122, a red region 124, a black region 126, an odd region 128 and a "19–36" region 130. Each of regions 104–130 of layout 100 function substantially as described above with respect to layout 60 (shown in FIG. 4). Layout 100, like layout 60 does not include a region corresponding to Dead Number pocket 34, and the basic play of the game is therefore as described above. It is recognized, of course, that other configurations of layouts and other payout distributions for bets placed thereon may be used within the scope of the present invention.

Figure 6:
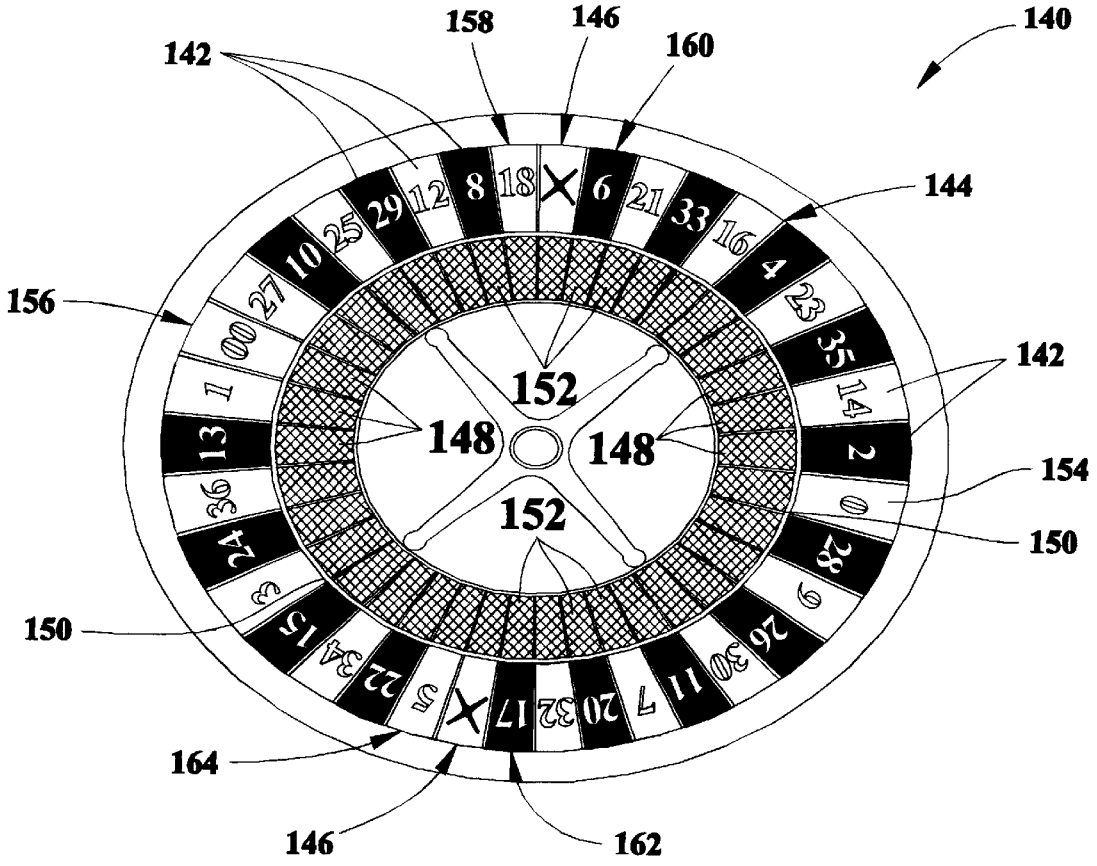
FIG. 6 a top plan view of a Roulette wheel including two "Dead Number" pockets in accordance with a second embodiment of the invention.

FIG. 6 is a top plan view of a second embodiment of a Roulette wheel 140 in accordance with the present invention. Roulette wheel 140 includes a plurality of fields 142 around an outer periphery 144 of wheel 140. Fields 142 includes indicia, such as an arabic number 0–36, or a symbol, such as those on "Dead Number" fields 146, corresponding to a plurality of pockets 148 located around an inner periphery 150 of wheel 140. Each pocket 148 is formed by dividers 152 below each field 142, and each pocket 148 is generally referred to by the corresponding field 142. For example, the "0" pocket is the pocket aligned with the "0" field. Wheel 140 is similarly constructed as wheel 10 (shown in FIG. 1) for use in Roulette table 28 (shown in FIG. 2).

Roulette wheel 140 includes a plurality of fields numbered 0, 00, and 1–36. Each field 1–36 is associated with a color, which is red or black by convention, that forms a background for each number indicated on outer periphery 144 of wheel 140. A "0" field 154 and "00" field 156 is conventionally associated with the color green. The arrangement of fields 142 numbered 0, 00, and 1–36 around outer periphery 144 of wheel 140 is also conventional. It is recognized, however that greater or fewer numbers of fields 142 and pockets 148 could be used, and that non-conventional distribution of the numbered pockets and non-conventional background colors could be used in the game of the present invention.

Wheel 140 is similar to an "American" or "Double Zero" wheel. However, unlike conventional American Roulette wheels, wheel 140 includes two "Dead Number" fields 146 that are the same size as fields 142. Thus, instead of the conventional thirty-eight fields numbered zero, double zero, and one through thirty-six, wheel 140 has two additional Dead Number fields 146, or a total number of forty fields corresponding to forty pockets. As shown, each Dead Number field 146 is positioned substantially equidistant between "0" field 154 and "00" field 156 on wheel outer periphery 144. Consequently, Dead Numbers 146 are located between an "18" field 158 and a "6" field 160 and a "17" field 162 and a "5" field 164. Of course, Dead Number fields 146 could be positioned anywhere on wheel outer periphery 144 without affecting the play of the game. Dead Number fields 146 are indicated as shown and described above with respect to FIG. 3, although it is contemplated that greater or fewer Dead Number pockets 146 could be used with the same or different indica than shown or described herein.

Figure 7:
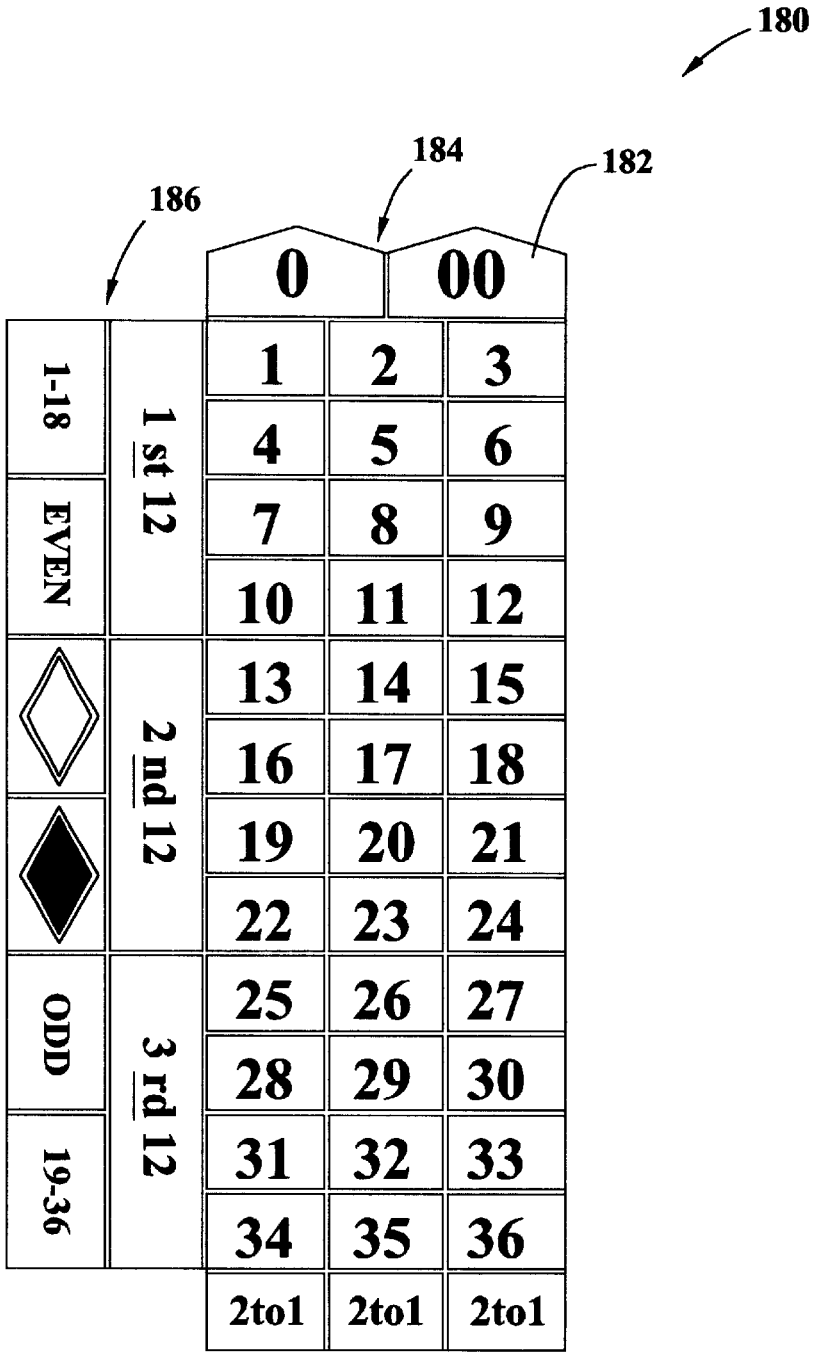
FIG. 7 is a top plan view of a bet layout for use with the wheel shown in FIG. 5.

FIG. 7 is a top plan view of a layout 180 for use with wheel 140 (shown in FIG. 6) which will be recognized by those in the art as an "American" layout, and differs from American layout 100 (shown in FIG. 5) only by the inclusion of a "00" region 182, which in one version of the game, like its counterpart "0" pocket 154 in wheel 140 (shown in FIG. 6), forfeits all bets except those successfully wagered on it when the ball comes to rest in "00" pocket 156 in wheel 140. In another version of the game popular in Europe, all bets except 1:1 payout bets and bets wagered on "0" pocket 154 or "00" pocket 156 in wheel 140 lose, and 1:1 payout bets lose half of their value when the ball lands in "0" pocket 154 or "00" pocket 156. Otherwise, a center portion 184 and a left portion 186 of layout 180 are substantially as described above with respect to FIG. 5.

The play of American Roulette using wheel 140 and layout 180 is substantially unchanged from that described above, with two exceptions. First, the game involves two zero pockets 154, 156 and two Dead Number pockets 146, rather than one of each as described in relation to FIGS. 1–5, and second, an additional bet is possible by virtue of the "00" filed adjacent the "0" field in region 184. The bet consists of five numbers, namely, "0", "00", "1". "2", and "3" and has a payout of 6:1.

With these adaptations, players place their bets on layout 180, and Roulette wheel 140 is rotated about a rotational axis (not shown). At least one ball is introduced tangentially to wheel outer periphery 144 and in a direction opposite the rotation of wheel 140 according to known methods in the art. Eventually, gravitational forces cause the ball to fall into a pocket 148 on wheel 140. After multiple revolutions around wheel 140, the Roulette ball is pulled downward into one of pockets 148 by gravitational forces. Once the ball has come to a final position in a particular pocket 148, bets are paid or collected in accordance with bets placed on layout 180.

However, if the ball falls into one of Dead Number pockets, i.e, one of the pockets corresponding to Dead Number fields 146 (shown in FIG. 6), a "Dead Number" is declared and all bets are collected except bets on individually numbered pockets 148 of wheel 140. In other words, the bets on individually numbered pockets 148, i.e, the bets placed in center portion 184 of layout 180, namely "straight up" bets, "split" bets, "corner" bets, "street" bets, and "six line" bets are unaffected, while bets in a all remaining regions lose and are collected by the house. A new deal is declared after all bets have been collected except bets on center portion 184 for individually numbered pockets 148 of wheel 140. In the new deal Roulette wheel 140 is again rotated in the opposite direction to the preceding spin, and the Roulette ball is again introduced tangentially to outer periphery 144 of wheel 140 and in a direction opposite the rotation of wheel 140 for a new round of play. New bets may be placed until "No more bets" is announced.

No region on bet layout 180 corresponds to Dead Number pockets 146, so bets cannot be placed on Dead Number pockets 146. Thus, instead of creating another betting opportunity on layout 180, Dead Number pockets 146 give previously chosen, high payout bets another, or second, chance while forfeiting lower bets when the ball falls into Dead Number pockets 146. Thus, a simple but interesting sequence of events is added to the game that makes the game more enjoyable and exciting. Moreover, the Dead Number may be practiced with known variations of the game, including electronic enhancements using computers and video displays, virtual displays, multiple Roulette ball games and various side bet opportunities known in the art.

While the invention has been described in terms of various specific embodiments, those skilled in the art will recognize that the invention can be practiced with modification within the spirit and scope of the claims.

What is claimed is:

1. A method of playing a Roulette game including a Roulette wheel adapted for rotation about a rotational axis and at least one bet layout, the Roulette wheel including a plurality of numbered pockets, at least one ball, and at least one Dead Number pocket, each numbered pocket indicated by a color and a number greater than zero on a periphery of the wheel, the Dead Number pocket indicated by non-number indicia and a color other than the colors of said numbered pockets, the bet layout including a plurality of regions on which to place a bet by placing a number thereon, said method comprising the steps of:

placing bets on the position of the ball in the Roulette wheel at the conclusion of a round of play, the bets made by placing markers on the at least one bet layout;

rotating the Roulette wheel about the rotational axis;

introducing the at least one ball tangential to the periphery of the wheel and in a direction opposite the rotation of the wheel, the at least one ball eventually falling into a pocket on the wheel;

paying bets accordingly in response to the final position of the ball; and if the ball falls into the at least one Dead Number pocket, collecting all bets except bets on individually numbered pockets and those bets placed on number combinations.

2. A method in accordance with claim 1 further comprising the step of allowing new bets after the ball falls into the at least one Dead Number pocket.

3. A method in accordance with claim 1 further comprising the step of rotating the wheel after the at least one ball falls into the at least one Dead Number pocket, thereby giving bets on individually numbered pockets a second chance.

4. A method in accordance with claim 3 wherein said step of rotating the wheel comprises the step of rotating the wheel in an opposite direction to the preceding rotation of the wheel.

5. A method in accordance with claim 3 further comprising the step of introducing at least one ball tangential to the periphery of the wheel and in a direction opposite the rotation of the wheel, thereby commencing a new round of play.

6. A method of playing a roulette game comprising:

placing bets on a final position of a roulette ball in a roulette wheel at the conclusion of a round of play, the roulette wheel comprising a plurality of numbered pockets, each of the numbered pockets indicated by a number on a periphery of the wheel and at least one Dead Number pocket interspersed with the plurality of numbered pockets on the periphery of the wheel, the at least one Dead Number pocket indicated by non-numbered indicia, the bets being placed on a betting layout which includes single numbers and combinations of numbers;

rotating the roulette wheel about a rotational axis;

introducing a roulette ball to the wheel in a direction opposite to the rotation of the wheel;

paying and collecting bets according to the final position of the roulette ball; and if the final position of the ball is a Dead Number pocket, allowing those bets placed on a single number and those bets placed on a number combination to be played again.

7. A method of playing a roulette game according to claim 6 wherein the roulette wheel includes 38 numbered pockets, the pockets numbered 0, 00, and 1–36.

8. A method of playing a roulette game according to claim 6 wherein the roulette wheel includes 37 numbered pockets, the pockets numbered 0–36.

9. A method of playing a roulette game according to claim 6 wherein the roulette wheel includes two Dead Number pockets.

* * * * *